US006589387B1

(12) United States Patent
Leino et al.

(10) Patent No.: US 6,589,387 B1
(45) Date of Patent: Jul. 8, 2003

(54) PROCESS FOR IMPROVING THE DRAINAGE OF CELLULOSIC PULPS BY ADDING CARBON DIOXIDE DIRECTLY INTO THE PULP

(75) Inventors: Hannu Juhani Leino, Espoo (FI); Anna Linnea Holmberg, Lidingö (SE)

(73) Assignee: AGA Aktiebolag, Lidingo (SE)

( * ) Notice: Subject to any disclaimer, the term of this patent is extended or adjusted under 35 U.S.C. 154(b) by 0 days.

(21) Appl. No.: 09/530,740

(22) PCT Filed: Nov. 3, 1998

(86) PCT No.: PCT/FI98/00851

§ 371 (c)(1),
(2), (4) Date: Jun. 8, 2000

(87) PCT Pub. No.: WO99/24661

PCT Pub. Date: May 20, 1999

(30) Foreign Application Priority Data

Nov. 5, 1997 (FI) ..... 974145

(51) Int. Cl.[7] ..... D21C 9/00; D21C 9/18; D21F 1/66

(52) U.S. Cl. ..... 162/63; 162/100; 162/190; 162/208

(58) Field of Search ..... 162/4, 8, 9, 190, 162/63, 100, 289, 202, 208

(56) References Cited

U.S. PATENT DOCUMENTS 6,200,416 B1 * 3/2001 Brotto et al. ..... 162/4

FOREIGN PATENT DOCUMENTS

| | | |
|---|---|---|
| EP | 0 281 273 B1 | 7/1993 |
| EP | 0 572 304 B1 | 12/1993 |
| EP | 0 884 416 A2 | 12/1998 |

OTHER PUBLICATIONS

"Flow Sheet of Pulp and Ppaer Manufacture", Paper Trade J., Jun. 22, 1939.*

Ostberg et al., 5th Internatl. Conf. on New Avail. Technique--Stockholm, "Use of Carbon Dioxide in the Production of Sulphate Pulp," Jun. 1996, pp. 508–515.

"Brownstock Washing with CO2," (Pulp & Paper Canada, vol. 98, No. 7), Jul. 1997.

WO 88/04705, "Method for Washing of Alcaline Pulp," Monica Bokström et al., Jun. 1988.

* cited by examiner

*Primary Examiner*—Steve Alvo
(74) *Attorney, Agent, or Firm*—Pearne & Gordon LLP

(57) ABSTRACT

The invention relates to a process for improving the drainage or dewatering of cellulosic pulp suspensions in a paper making machine, a drying machine or the like assembly. The invention also relates to a process for producing a dried cellulosic product from said pulp suspension. The drainage of said pulp suspension is improved by treating it with carbon dioxide just prior to its entering a dewatering device such as the wire section of a paper machine.

12 Claims, No Drawings

PROCESS FOR IMPROVING THE DRAINAGE OF CELLULOSIC PULPS BY ADDING CARBON DIOXIDE DIRECTLY INTO THE PULP

The present invention relates to a process for improving the drainage or dewatering of cellulosic pulps in a paper making machine, a drying machine or the like assembly. The invention also relates to a process for producing a dried cellulosic product from a cellulosic pulp suspension, which process comprises dilution of said pulp with water, feeding the diluted suspension into a web forming dewatering means, and drying to provide a desired cellulosic product, such as paper, board or pulp.

In the production of paper and board, as well as in the production of various other cellulosic products, a cellulosic pulp suspension is produced by various mechanical and chemical treatments of the cellulosic raw material.

In the production of paper or board the cellulosic pulp suspension enters the stock preparation of a paper machine and Generally undergoes beating, after which it is called stock. Through gradual dilution with white water the stock consistency is lowered to about 3–4%. To produce paper with good formation, high strength and high quality, the consistency must be lowered further down to about 0.1–1%, which is done in the short circulation using white water straight from the wire section.

The stock is sprayed out of the head box to a wire, where it is dewatered to a dry solids content of about 20% and then called web. The web is further dewatered in the press section by passing through one or more press nips. In the drying section the web is in contact with hot drying cylinders and the dry solids content is raised to a final 90–98%. The final paper may be rolled up on a roll, and may then be further processed in a winder or in a sheeting machine.

In a pulp mill the cellulosic pulp suspension is similarly directed to stock preparation and fed to a drying machine. The stock is generally screened and diluted with white water in a short circulation to a consistency of about 0.9 to 2%, then fed to through a head box onto a dewatering device such as a wire section. The dewatered web is subsequently pressed, dried and wound or cut into a final product. The dried pulp so produced is either used as an intermediate product for paper formation or to provide finished cellulosic products of various forms.

Irrespective of whether the pulp suspension will form dried pulp or paper or board, the consistency of the pulp suspension being fed to the dewatering means of the product producing assembly is very low, below 2% and often below 1%. The high water content is needed in order to produce a desired end product. However, most of the water in the suspension is drained off immediately after the head box in a dewatering means such as the wire section of a Fourdrinier machine or a twin wire machine.

For instance, in the production of paper the stock consistency in the head box is as low as 0.1–1% and huge amounts of water need to be drained on the wire section. If a paper machine runs at 500 m/min, has a width of 6 m, produces a grammage of 150 g/m$^2$ and has a stock consistency of 0.5%, the total flow out of the head box is 90000 1/min. 99.5% of that flow is water and most of that has to be removed before the end of the wire section. The drainage must be carried out in a controlled manner not to affect the final cellulosic product negatively.

If the drainage is improved, the producer can make use of that by e.g. increasing the speed or decreasing the concentration in the head box further. The first-mentioned alternative will increase the production and the latter will improve the formation of the web, which is positive for many quality parameters.

There are a number of conventional ways of improving the dewatering, e.g. by adjusting the vacuum under the wire, by using mechanical devices such as foils or by the addition of chemicals aids. However, there is still a need for improving the drainage of cellulosic pulps in the dewatering means of paper and pulp mills and the present invention aims at meeting this need.

It has now been found that treating an aqueous cellulosic pulp suspension with carbon dioxide just prior to its entering the dewatering means surprisingly improves the drainage of the aqueous pulp suspension in a significant way.

Accordingly, the present invention concerns a process for improving drainage of a cellulosic pulp suspension in a web forming dewatering device, comprising treating said pulp suspension and/or the water used for diluting the same with carbon dioxide just prior to said pulp suspension entering said dewatering device, said carbon dioxide being used in an amount sufficient to significantly improve the drainage in said dewatering device.

The pulp suspension to be treated with the carbon dioxide according to the invention may be any stock which has entered the short circulation of a paper making machine in a paper mill or a drying machine in a pulp mill. Said pulp may comprise virgin fibers or recycled fibers or any combination thereof.

For the proper performance of the invention the carbon dioxide should be fed into the pulp suspension at a location close to the dewatering device. In fact, the carbon dioxide addition point should be in the short circulation, after any machine screening and close to the head box.

In the preferred embodiment of the invention the carbon dioxide is fed in the form of gaseous carbon dioxide directly into the flow entering the head box which feeds the suspension into the dewatering device. Feeding of carbon dioxide gas in accordance with the invention into the flow at this very sensitive location of a paper machine surprisingly does not negatively affect the web formation on the subsequent wire section. On the contrary, the feeding of the carbon dioxide provides an immediate and clearly visible improvement in the drainage as the dry line on the wire section, i.e. the boundary between reflecting and non-reflecting regions of the upper surface of the fibre mat, moves back in response to the addition of carbon dioxide.

The carbon dioxide may also be introduced into the water used to dilute the pulp suspension just prior to the head box, such as into the white water in the short circulation of a paper machine or a drying machine.

The amount of carbon dioxide introduced into the flow according to the invention should not exceed the amount capable of dissolving in said flow. The amount of carbon dioxide introduced into a pulp suspension just prior to a dewatering device should be about 0.5 to 5 kg $CO_2$/ton paper or pulp, preferably about 1 to 3 kg $CO_2$/ton paper or pulp.

The carbon dioxide may be added in the form of liquid or solid carbon dioxide or as carbon dioxide dissolved in a liquid. However, addition in gaseous form is considered the preferred form. Gaseous carbon dioxide is easy to distribute uniformly into the liquid flow and it has not been found to provide eddies or turbulence in the flow.

The mechanism by which the carbon dioxide added in accordance with the invention performs its beneficial action on the drainage of the water from the cellulosic pulp is not known. However, the effect of the added carbon dioxide is clearly visible and reproducible, as described above.

Carbon dioxide has previously been used in paper making for improving the washing of pulp as described in EP Patent 0 296 198 (AGA Aktiebolag). Here the carbon dioxide is added to washing water or in a washing device in an amount which lowers the pH of the pulp and improves the washing-out of substances which contribute to chemical oxygen demand (COD).

Carbon dioxide has also been used in the sizing of an aqueous pulp with alkylketene dimers to provide bicarbonate ions required to catalyze the reaction between the sizing agent and the cellulose, as disclosed in EP Patent application 0 572 304 (Canadian Liquid Air Ltd).

Finally, carbon dioxide has been used to regulate the pH of a pulp suspension which is to be fibrilated in a refiner, as disclosed in EP Patent 0 281 273 (The BOC Group, Inc.). According to said Patent gaseous carbon dioxide is introduced into an alkaline cellulosic pulp upstream of the fibrilation step. The carbon dioxide feed is regulated to provide a pH of 8.5 to 6.5 in the fibrilation step. The lowered pH at refining is said to improve the physical properties of the paper and to make possible abetter drainage of the pulp. An additional amount of carbon dioxide may be introduced after refining to further lower the pH to 7.0–5.5 prior to introduction into the paper making assembly.

The above prior art use of carbon dioxide does not suggest adding carbon dioxide into the low consistency stock in the short circulation and it is believed that there is a strong prejudice in the art for adding a gas to the stock flow just prior to the head box. However, in the present invention the adding of the carbon dioxide is performed as close to the head box as practically possible in order to have the fresh carbon dioxide in the flow as it enters the wire section.

The present invention also concerns a process for producing a final cellulosic product such as paper, board or dried pulp. According to the invention the process comprises dilution of a pulp suspension with water, feeding the diluted suspension into a dewatering means, and drying to provide a desired cellulosic product, such as paper, board or pulp. The drainage of the suspension in said dewatering device is improved by the introduction of carbon dioxide into said pulp suspension and/or into said diluting water just prior to said pulp suspension entering said dewatering device, said carbon dioxide being used in an amount sufficient to significantly improve the drainage in said dewatering device.

Above, the invention has been described with reference to a typical paper making machine and with feeding of carbon dioxide close to the head box. It is however, obvious to those skilled in the art that the invention may be used also in other types of machines for producing paper, board or pulp and that the carbon dioxide may be mixed into the flow at various other points not far from the head box.

The invention will now be further illustrated by some examples, which are, however, not to be considered as limiting the invention in any way.

EXAMPLE 1

In a mill one board machine produced board from fully bleached kraft pulp. The machine had an air cushion head box and a conventional Fourdrinier wire section. The major grade produced on the machine was a grammage of 150 g/m$^2$.

A first trial was conducted, which involved addition of 2 kg $CO_2$/ton of board to the stock just prior to the head box. The grammage and all process control parameters concerning the short circulation, the head box and the wire section were kept constant during a reference period as well as during the trial. The addition point was located after the machine screen and before the head box.

Very shortly after the $CO_2$ addition was started, the position of the dry line on the wire section backed almost 20 cm due to improved dewatering.

Process parameters in the press and drying sections were adjusted to ensure that the final moisture content of the board was not effected negatively. After 2.5 hours the $CO_2$ addition was stopped and the dry line more or less immediately returned to its first position.

EXAMPLE 2

A second trial was performed on the same paper machine and in the same manner as in Example 1. Once again the dry line backed when 2 kg $CO_2$/ton board was added before the head box, but this time the improved dewatering was used to decrease the stock consistency in the head box. Since the speed was kept constant, the decreased consistency resulted in more water being sprayed on to the wire and the dry line therefore moved back close to its original position. The formation of the board was improved.

EXAMPLE 3

In order to evaluate the effect of the $CO_2$ feed on the pH and the gas content of the pulp suspension, the following test was performed:

A paper machine head box was fed a stock of bleached kraft pulp having a consistency of 0.4% and a pH of 4.6. The machine was set to produce a paper having a grammage of 80 g/m$^2$. Carbon dioxide gas was added to the flow prior to the head box in an amount of about 2.5 kg $CO_2$/ton paper.

As described above, the dry line on the wire backed about 20 cm as soon as the $CO_2$ feeding was begun and moved to its original position when the feeding was stopped. The pH and the gas content of the stock pulp suspension was measured after the $CO_2$ addition point just before the head box.

The pH of the flow entering the head box did not change in response to the $CO_2$ feed. It remained throughout the test at about 4.6. Thus, the improved dewatering was not due to a pH change.

Although gaseous carbon dioxide was fed into the suspension before the head box, no gas bubbles were found in the suspension entering the head box. Analysis of the gas content of the aqueous suspension indicated that all the $CO_2$ had dissolved.

What is claimed is:

1. A process for improving drainage of a cellulosic pulp suspension in a web forming dewatering device, said suspension being diluted with water and fed into a head box, and from the head box to the dewatering device, characterized in that at a location close to the head box, carbon dioxide in the form of carbon dioxide gas is directly introduced into said pulp suspension entering a the head box in the short circulation of a wire section, said carbon dioxide being introduced in an amount sufficient to provide fresh carbon dioxide as it enters the dewatering device to significantly improve drainage in said dewatering device.

2. The process according to claim 1, characterized in that said dewatering device comprises a wire section of a paper machine or a drying machine.

3. The process according to claim 1, characterized in that said carbon dioxide is introduced in an amount of 0.5 to 5.0 kg/ton paper or pulp.

4. The process according to claim 3, characterized in that said carbon dioxide gases introduced into a paper making stock having a consistency of about 0.1 to 1.0%.

5. The process according to claim 3, characterized in that said carbon dioxide gas is introduced into a pulp stock having a consistency of about 0.9 to 2.0%.

6. The process according to claim 1, characterized in that said carbon dioxide is introduced in an amount of 1 to 3 kg/ton of paper or pulp.

7. The process according to claim 1, characterized in that said carbon dioxide is introduced as the last treatment before said head box.

8. A process for producing paper, board or dried pulp from an aqueous cellulosic pulp suspension which is diluted with water and fed into a head box, and from the head box fed to a dewatering device for providing a web which is passed on through pressing and drying to a final product, characterized in that at a location close to the head box, carbon dioxide in the form of carbon dioxide gas is directly introduced into said pulp suspension entering the head box in the short circulation of a wire section, said carbon dioxide gas being introduced in an amount sufficient to provide fresh carbon dioxide in the flow as it enters the dewatering device to significantly improve the drainage in said dewatering device.

9. Process according to claim 8, characterized in that said carbon dioxide is introduced into said pulp suspension immediately prior to a head box feeding said suspension to said dewatering device.

10. Process according to claims 8 or 9, characterized in that said carbon dioxide is introduced in an amount of 0.5 to 5 kg/ton paper or pulp.

11. Process according to claims 8 or 9, characterized in that said carbon dioxide is introduced in an amount of 1 to 3 kg/ton paper or pulp.

12. The process according to claim 1 or 8, characterized in that said carbon dioxide is introduced in an amount which does not exceed the amount capable of dissolving in said pulp suspension.

* * * * *